US005390006A

United States Patent [19]

Wakabayashi et al.

[11] Patent Number: 5,390,006

[45] Date of Patent: Feb. 14, 1995

[54] IMAGING FORMING APPARATUS WITH IMPROVED EXHAUST FLOW

[75] Inventors: Tomio Wakabayashi, Hatano; Keiji Okamoto; Rikio Kasahara, both of Yokohama, all of Japan

[73] Assignee: Ricoh Company Ltd., Tokyo, Japan

[21] Appl. No.: 982,944

[22] Filed: Nov. 30, 1992

[30] Foreign Application Priority Data

Nov. 29, 1991 [JP] Japan ..... 3-316543

[51] Int. Cl.[6] ..... G03G 21/00

[52] U.S. Cl. ..... 355/215; 219/216; 355/28; 355/30

[58] Field of Search ..... 355/215, 282, 285, 289, 355/290, 30; 219/216

[56] References Cited

U.S. PATENT DOCUMENTS

| | | | |
|---|---|---|---|
| 3,357,325 | 12/1967 | Eichorn et al. | 355/275 |
| 4,571,056 | 2/1986 | Tani et al. | 219/216 X |
| 4,693,588 | 9/1987 | Yarbrough et al. | 219/216 X |
| 4,974,033 | 11/1990 | Yamada et al. | 355/200 |
| 5,121,168 | 6/1992 | Aoki et al. | 355/298 |
| 5,210,576 | 5/1993 | Haneda et al. | 355/274 |

FOREIGN PATENT DOCUMENTS

| | | | |
|---|---|---|---|
| 99132 | 1/1984 | European Pat. Off. | 355/215 |
| 5631 | 1/1978 | Japan | 355/215 |
| 166565 | 7/1991 | Japan | 355/215 |

*Primary Examiner*—Benjamin R. Fuller
*Assistant Examiner*—John Barlow
*Attorney, Agent, or Firm*—Oblon, Spivak, McClelland, Maier & Neustadt

[57] ABSTRACT

An image forming apparatus having improved air flow and/or handling of toner or other debris between a fixing device and an image carrier. In accordance with one aspect of the invention, the completeness and effectiveness of an air exhaust system of an image forming apparatus is improved by utilizing a flow improvement board which is located between the image carrier and the fixing device. The flow improvement board can be mounted upon the fixing device and extends downwardly beyond the fixing device. The flow improvement board provides a more regular flow of air toward the exhaust device thereby improving the effectiveness and completeness of the exhaustion of air. In addition, in accordance with another aspect of the invention, a magnet can be provided upon the board or associated with the fixing device, with the magnet including a plurality of poles which alternately extend along the widthwise direction of the mixing device. The magnet removes floating toner, and is oriented for most effective results with the flow produced by the flow improvement board.

20 Claims, 8 Drawing Sheets

IMAGING FORMING APPARATUS WITH IMPROVED EXHAUST FLOW

BACKGROUND OF THE INVENTION

1. Field of the Invention

The invention relates to image forming apparatuses, such as printers, copying machines, facsimile machines, etc., which record images on a sheet of paper using an electrophotographic process. The invention is particularly advantageous in the context of small image forming apparatuses having a heat type fixing device, however, various features of the present invention may also be advantageously utilized in a wide variety of image forming apparatuses.

2. Discussion of Background

Image forming apparatuses, such as printers, copying machines, facsimile machines, etc., must meet a number of requirements, such as a fast printing speed, high printing image quality, and often the requirement for color printing. In addition, there is currently a great demand for image forming apparatuses which are suitable for personal use. In the personal use market, providing an image forming apparatus which is compact and low in cost is of the utmost importance. However, providing a compact apparatus requires a high density disposition of the various components within the apparatus, which can lead to several problems.

One of the problems in providing a compact image forming apparatus is that a heat type fixing device can be in close proximity to an image carrier or photosensitive body, which is utilized in forming an image on the paper. With the heat type fixing device installed in close proximity to the photosensitive body, water/moisture in the paper can evaporate from the paper, such that moist air is present in the region of the photosensitive body. Starchy materials of the paper may also be present in the air in the region of the photosensitive body, and such undesirable substances can adhere to the photosensitive body. As a result, the image quality can deteriorate, for example, image portions which should be black become white in the final image formed on the paper, or vice versa.

FIGS. 12 and 13 show a small-size laser printer as an example of a small-size image forming apparatus. As shown in FIG. 12, numeral 10 designates the overall structure of the image forming apparatus, including an upper structure 10a, including, for example, a lid, and a lower structure 10b. The upper structure is mounted upon the lower structure by a shaft 11 to allow convenient opening and closing. A photosensitive body 12 is installed at approximately the center of the structure 10, with the various electrophotographic processing devices disposed about the photosensitive body, including a charger 13, developing device 14, transfer device 15 and cleaner 16. The photosensitive body rotates in the direction shown by the arrow.

A paper supply cassette is typically provided above the electrophotographic devices, with an optical writing device 18 installed below the electrophotographic devices. The paper is conveyed from the paper supply cassette by a paper feed roller 20, and is conveyed to the upper side of the photosensitive body 12 in properly timed relation utilizing a pair of resist rollers 21. As the photosensitive body rotates in the direction of the arrow, the surface of the photosensitive body is uniformly charged by the charger 13, and thereafter, an electrostatic latent image is formed on the photosensitive body

12 by light. This latent image is then realized or visualized by toner as the photosensitive body passes through the developing device 14. A transfer device then transfers the visualized image from the photosensitive body to a lower face of a sheet as the sheet of paper is conveyed in contact with the photosensitive body.

The sheet having the image formed thereon is then guided by a conveying guide 23, and then between a fixing roller 17*a* and pressurizing roller 17*b* which constitute a fixing device 17. The fixing device 17 fixes the visualized or developed image upon the sheet of paper. The sheet of paper from the fixing device 17 is then conveyed to a paper discharging section via a paper discharging roller. The conveyed sheet of paper is guided by the paper discharging guide 26, and then stacked upon a paper discharge tray 27.

An exhaust fan is typically installed in a left, back side of the image forming apparatus in relation to the operating side of the apparatus (i.e., with the operating side being at the right side of the apparatus shown in FIG. 12). FIG. 13 clearly illustrates a back, left location of a fan 50. The exhaust fan typically is near the fixing device 17 and charger 13, such that excessive operating temperatures (which may be caused by the fixing device) are avoided, and also such that any ozone (which may be attributable to the charger 13) is dissipated. However, in accordance with one aspect of the present invention, it has been recognized that typical exhaust system arrangements suffer from a number of performance shortcomings. Typically, during operation of the fan, air flow occurs about the photosensitive body near the fixing device as shown by the arrows in FIGS. 14 and 15. The fan is installed in the left, back side, and below the fixing device 17 as shown in FIGS. 12 and 13, such that it does not interfere with other components of the image forming apparatus. The air, typically including moisture, at the paper insert entrance thus flows down between the photosensitive body and the fixing device 17 as shown by the streamline A' in FIG. 14. As shown more specifically in FIG. 15, the air flows toward the underside of the fixing device and around the side opposite to that of the fan as shown at A in FIG. 15. Closer to the fan, the flow occurs in more of a horizontal direction as shown at B. Still closer to the fan, and as shown at C, the flows A and B are mixed, however, a regular flow is not produced, and portions of the air can thus accumulate, at least temporarily, in the region shown at C in FIG. 15. As a result, the image quality can deteriorate, and, in fact, such problems (i.e. poor image quality) have been recognized more frequently in the left side of the machine with reference to the operating position as described above.

Another problem caused by insufficient exhaust, relates to toner which is floating in the region between the photosensitive body and the fixing device, such as toner which has not adhered to the paper or the photosensitive body at a desired location. The floating toner can then adhere to a part of the paper or the photosensitive body at an undesirable location, thus lowering the print quality. The occurrence of such problems more frequently in the left side can also demonstrate the relationship of this problem to the ineffective exhaust.

Moreover, with a small-size image forming apparatus, for example as shown in FIG. 12, the fixing device 17 is closely adjacent to the photosensitive body 12, such that as a sheet of paper is being conveyed, the sheet can simultaneously contact part of the fixing roller 17*a* and part of the photosensitive body 12. The sheet can thus bridge across the gap between the photosensitive body and the fixing device, as shown in FIG. 12. As a result, air in the region between the photosensitive body and the fixing device, which may include moisture or other undesirable substances, cannot escape upwardly, and thus tends to remain in the region defined between the photosensitive body 12, the paper, and the fixing device 17.

Moreover, since the sheet of paper is conveyed on the upper side of the photosensitive body 12, the image is transferred to the lower side of the paper, and as the paper is conveyed between the transfer device 15 and the fixing device 17, toner at the underside of the paper can fall from the paper. Disassociation of the toner from paper can be caused by even very minute vibrations, often vibrations associated with conveyance of the paper.

Thus, problems associated with improper exhaust can be particularly severe in small-size image forming apparatuses. One solution to such problems could be the installation of a plurality of fans in order to make the exhaustion of air more complete. However, the provision for a plurality of fans can increase the cost and size of the image forming apparatus.

Accordingly, an improved exhaust flow arrangement is needed for image forming apparatuses. Such an exhaust flow system should be capable of providing a reliable and complete exhaustion of air, particularly air located in the region between the photosensitive body and the fixing device of an image forming apparatus in order to avoid deterioration in print quality. Moreover, the exhaust system should be suitable for use in a small size image forming apparatus, without increasing the size of the image forming apparatus.

SUMMARY AND OBJECTS OF THE INVENTION

Accordingly, it is an object of the present invention to provide an image forming apparatus which prevents problems associated with poor image quality.

It is another object of the present invention to provide an image forming apparatus having an improved exhaust system, thereby avoiding undesirable effects associated with substances associated with air which is typically located between a photosensitive body and a fixing device.

It is another object of the present invention to provide an image forming apparatus having improved exhaust flow characteristics, without requiring a substantial increase in size of the image forming apparatus, such that the exhaust system may be utilized in small and compact image forming apparatuses.

It is a further object of the present invention to provide an image forming apparatus in which problems associated with floating toner are reduced, thereby improving the image forming capabilities of the apparatus.

These and other objects and advantages are achieved by the present invention which provides for improved exhaust flow in an image forming apparatus. In accordance with one aspect of the present invention, a flow improving board is disposed between the photosensitive body and the fixing device in order to improve the effectiveness and completeness of the exhaust flow provided by the exhaust fan. The board improves the regularity of the flow, such that regions at which the flow tends to accumulate are avoided. In addition, in accordance with another aspect of the present invention, a magnet arrangement is provided in the region between the photosensitive body and the fixing device, with the magnet arranged so as to remove floating toner. Further advantages are achieved by the combined use of the flow improving board and magnet, with the flow improving board providing an optimal flow across the magnet arrangement for optimal removal of toner from the air.

BRIEF DESCRIPTION OF THE DRAWINGS

A more complete appreciation of the invention and the many attendant advantages thereof will become readily apparent from the following detailed description, particularly when considered in conjunction with the drawings in which:

FIGS. 12–14 illustrate conventional image forming apparatuses; and

DESCRIPTION OF THE PREFERRED EMBODIMENTS

Figure 1:
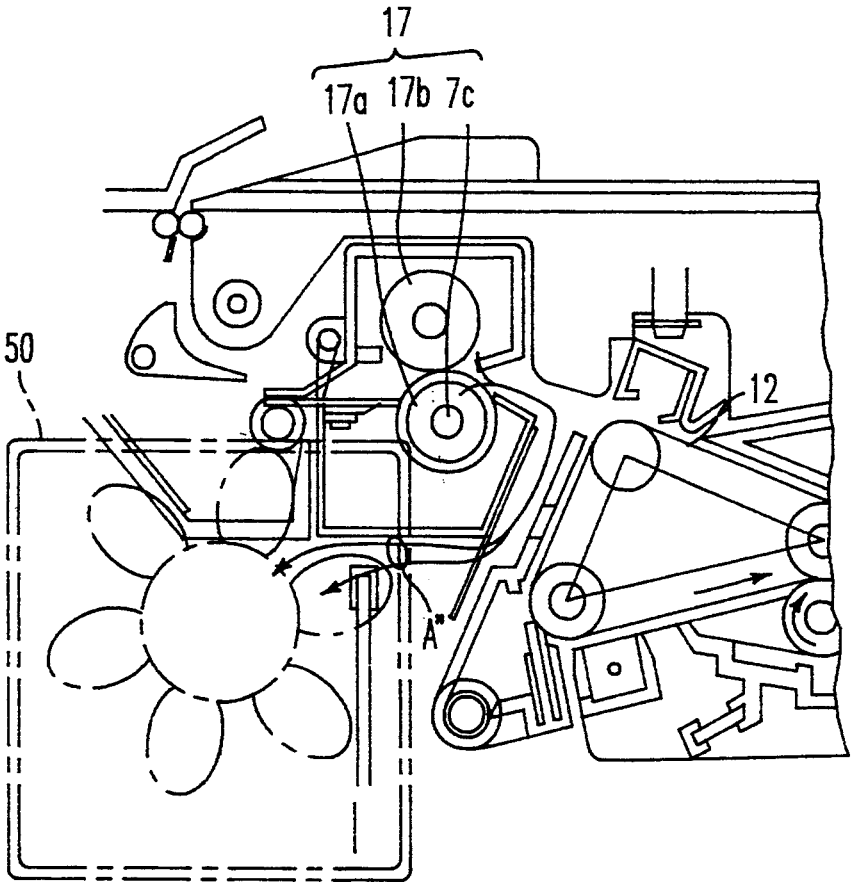
FIG. 1 shows a side view of an image forming apparatus in accordance with the present invention in which a flow improving board is disposed between the photosensitive body and fixing device.
Figure 12:
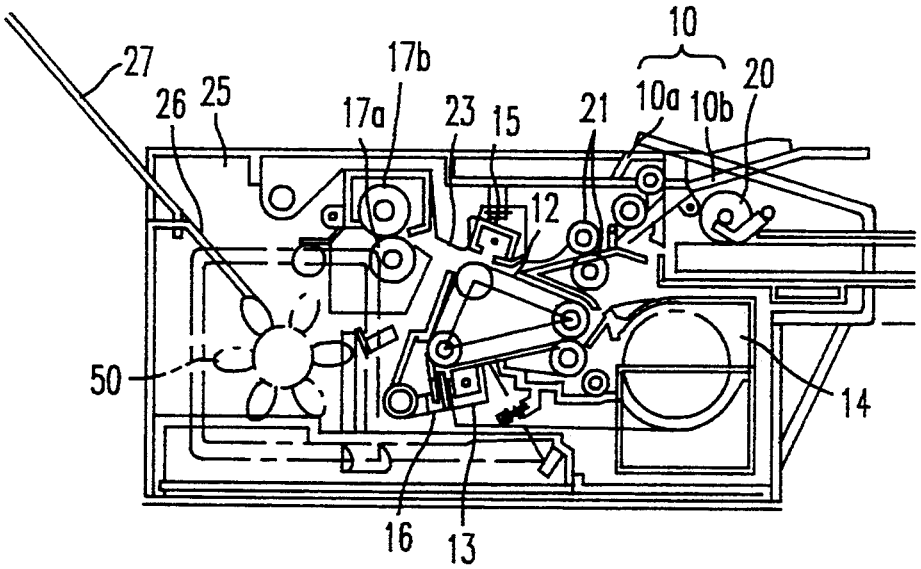
Figure 13:
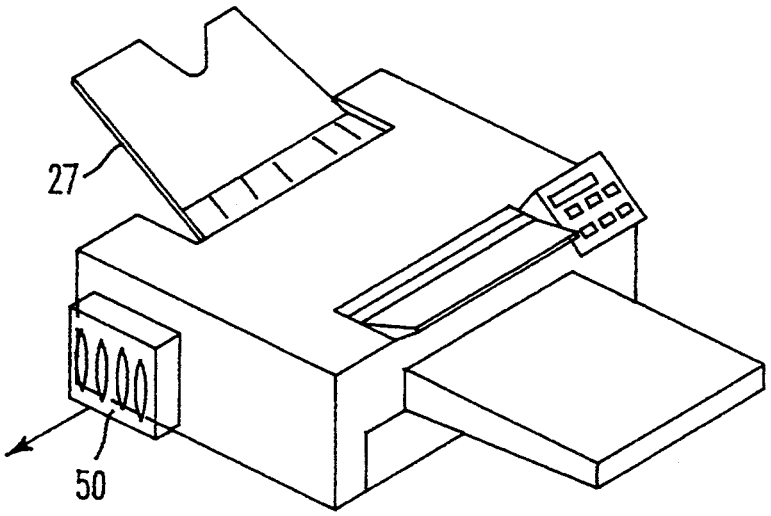

Referring now to FIG. 1, a first embodiment of the present invention will be described, with the invention particularly advantageous when utilized in a small size image forming apparatus, such as a small size printer discussed herein earlier with reference to FIG. 12. Corresponding elements between FIGS. 1 and 12 are designated with like reference numerals. The reference numeral 17C (not shown in the FIG. 12 arrangement) designates a heater which is utilized in the fixing device 17.

Figure 14:
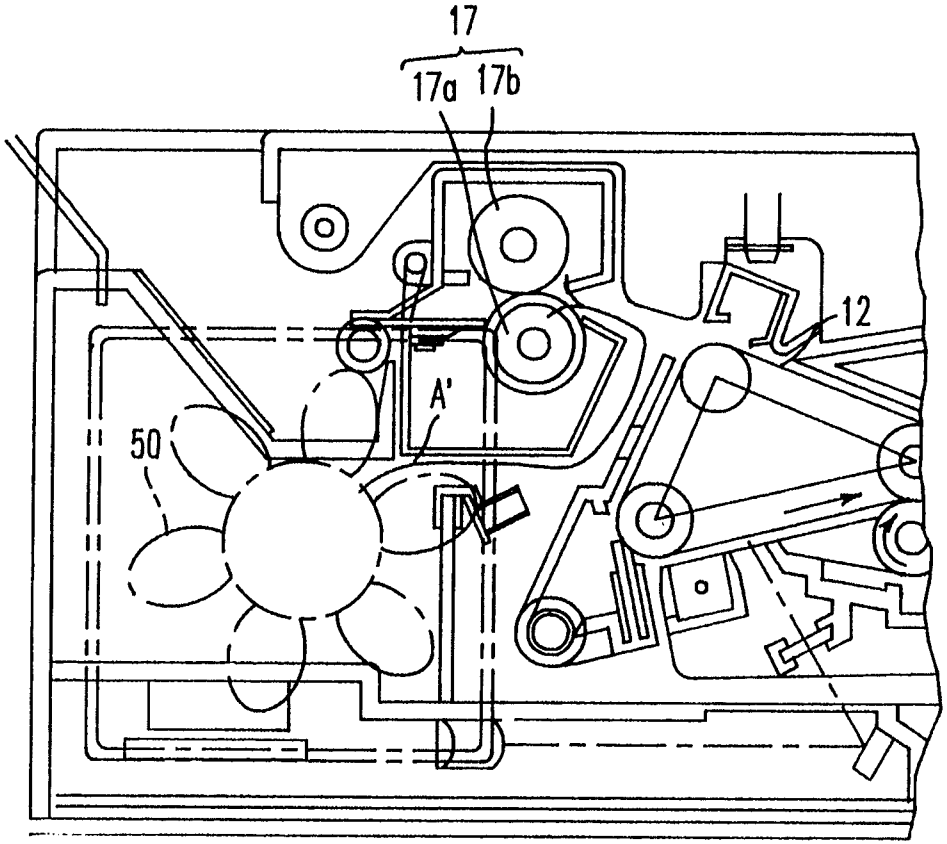
FIG. 14 PRIOR ART

Referring to FIG. 1, in accordance with one aspect of the present invention, a flow improving board 52 is provided between the fixing device 17 and the photosensitive body 12, with the board 52 mounted adjacent to the fixing device 17 in the arrangement shown in FIG. 1. The board provides a flow (described in further detail. hereinafter) which is much more desirable than the flow A′ shown in the arrangement of FIG. 14. As a result, more effective and complete exhaust of the air between the fixing device and the photosensitive body is attained, and the amount of air which is ineffectively exhausted or which accumulates in certain regions (i.e. as shown at C in FIG. 15) is reduced. Thus, the image quality is improved, since the adverse effects resulting from floating toner, moisture and/or starch substances are reduced. The board 52 has substantially the same width as that of the fixing device, and preferably extends downwardly as far as possible to promote an improved flow such that exhaust of the air is achieved with greater effectiveness.

Figure 2:
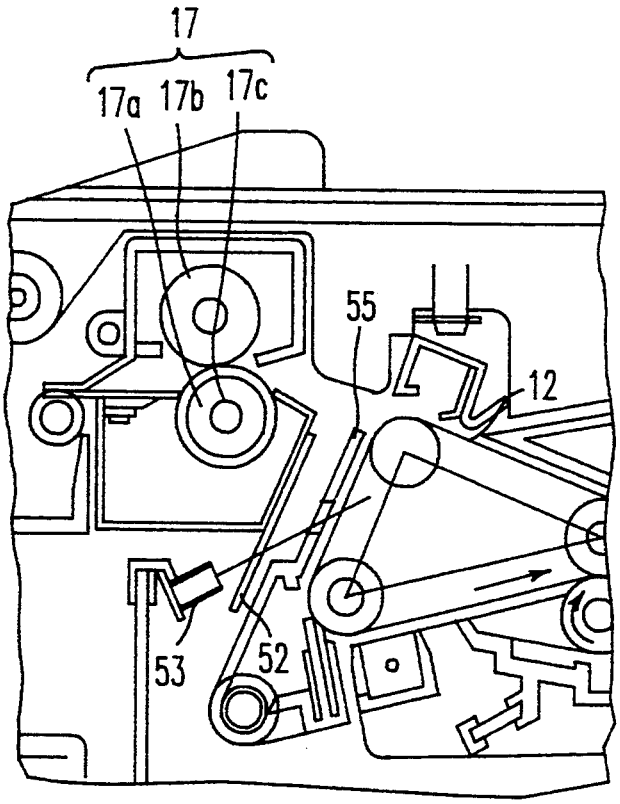
FIG. 2 is a side view of an image forming apparatus in accordance with the present invention, in which the image forming apparatus includes a flow improving board as well as an optical discharger.

Briefly referring to FIG. 2, in some types of image forming machines, an optical discharger 53 is installed, typically at a location below the fixing device 17. The optical discharger removes any remaining charge from the photosensitive body to return the photosensitive body to the initial electrical potential, for initiation of a subsequent image forming operation. In small size image forming apparatuses, the optical discharger is located as shown in the drawing figure to maintain compactness of the device. The light from the discharger 53 passes through an opening 56 installed in the case 55 for performing the discharging operation upon the photosensitive body 12. When the present invention is utilized in such an arrangement, care must be taken such that the board 52 does not block light from the discharger. Accordingly, in such an arrangement, the board is formed of a transparent material, such as polyethyleneterepthalate (known under the product name of Maira). Thus, the board promotes the flow for improved exhaust, while simultaneously allowing the charge to be removed from the photosensitive body by the discharger 53. After a period of time, if toner should accumulate upon the transparent board, the board can be removed to prevent interference with the optical discharger 53. Often, the photosensitive body is protected within a case 55, and therefore can be removed with the case 55 to facilitate cleaning of the board 52.

Figure 3:
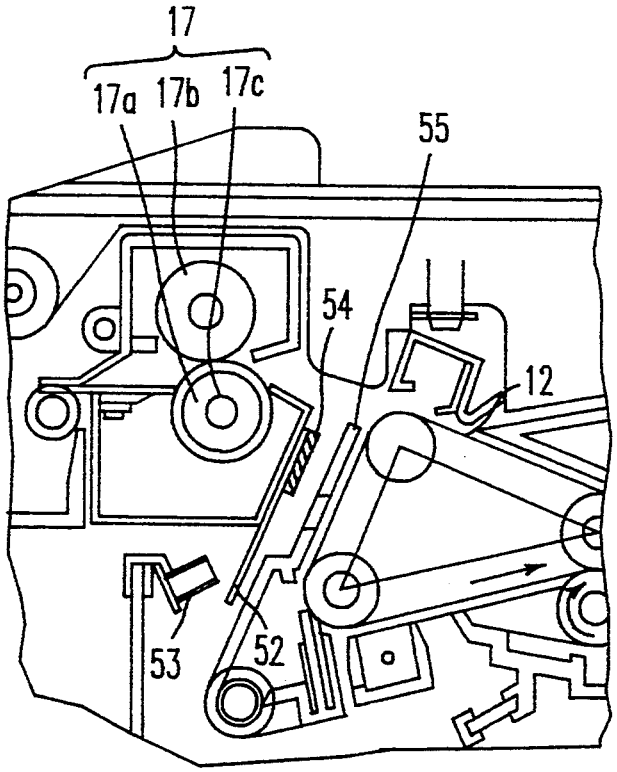
FIG. 3 is a side view of an alternate embodiment of the present invention.

Another embodiment of the present invention is shown in FIG. 3, in which a magnetic device 54 is utilized in conjunction with the board 52. As in the FIG. 2 arrangement, if an optical discharger 53 is utilized, the board is preferably formed of a transparent material. The magnetic device extends along the width of the fixing device 17, and can be installed on the case of the fixing device 17, or upon the board 52. When air flows across the magnet 54, magnetic toner contained within the air is captured by the magnet 54. As a result, floating toner is removed from the air, thereby preventing the floating toner from adhering to undesirable portions of the paper or photosensitive body 12. Thus, the magnet provides an additional improvement in the handling of the air and undesirable substances contained within the air.

The advantages attained by the embodiments of the present invention are particularly advantageous in a small size image forming apparatus, for example as shown in FIG. 12, in which the sheet can simultaneously bridge the fixing roller 17 and the transfer device 15 or photosensitive body 12. In accordance with the present invention, even where the paper thus bridges the gap between the photosensitive body and the fixing device, satisfactory handling of the air and undesirable substances contained therein is achieved. As described hereinafter, the magnet is particularly advantageous when utilized in conjunction with the board 52, however, it is to be understood that the magnet may also be utilized without the board in order to capture floating toner.

Figure 4:
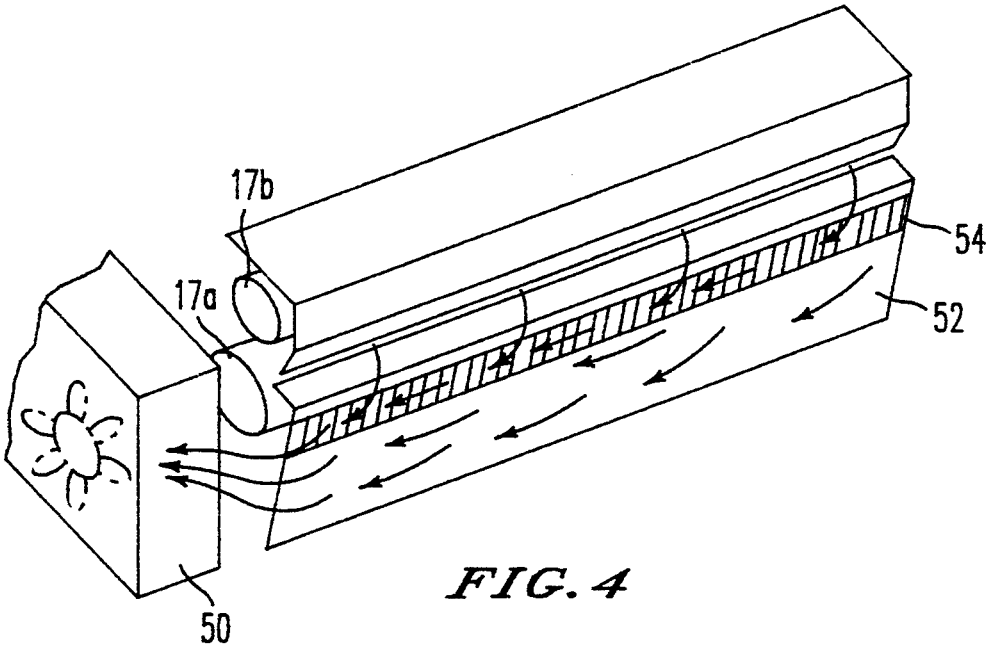
FIG. 4 is a perspective view of a portion of the arrangement shown in FIG. 3, showing the air flow across the flow improving board.
Figure 5A:
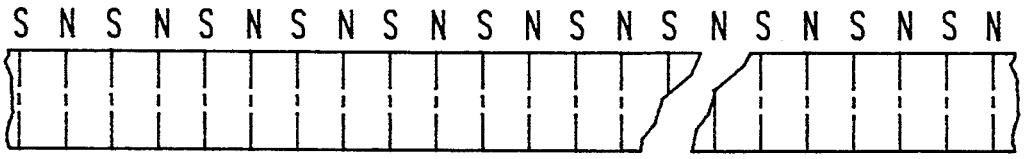
FIGS. 5A and B illustrate the magnet arrangement for use in accordance with the present invention, as well as a profile of the magnetic fields produced by the magnet arrangement.
Figure 5B:
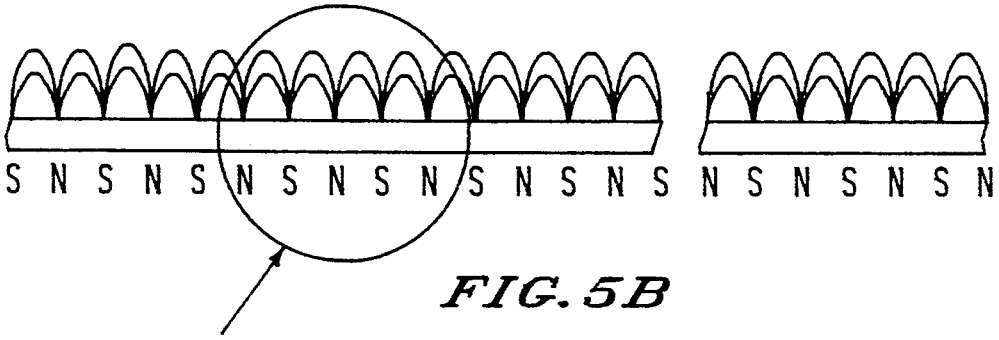
Figure 6:
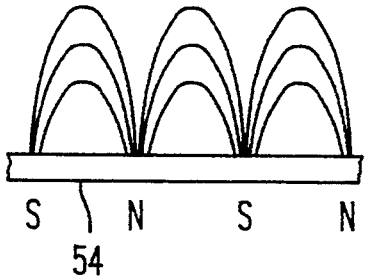
FIGS. 6–8 illustrate the importance of the coordination between the magnet and the flow provided by the exhaust system.
Figure 15:
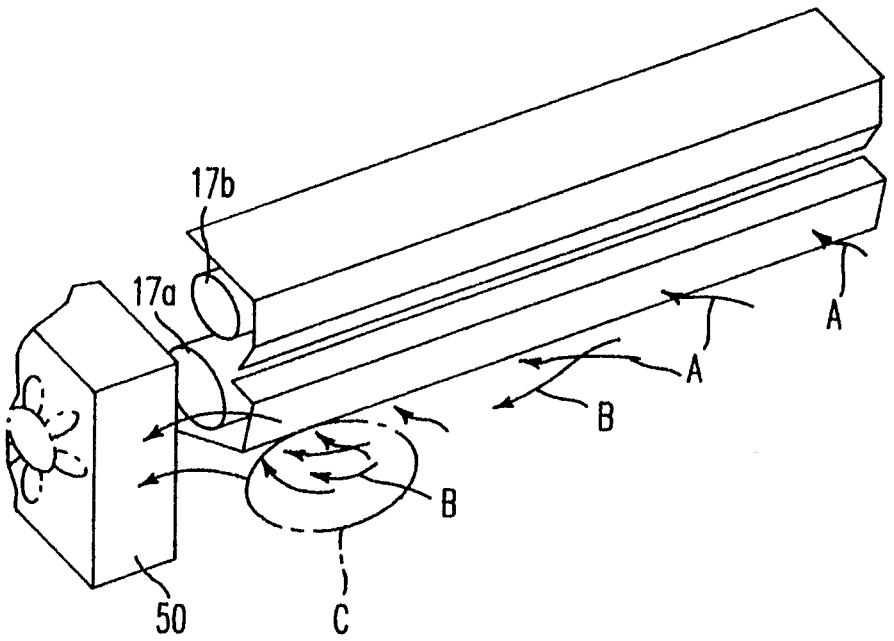
FIG. 15 PRIOR ART
FIG. 15 illustrates the exhaust air flow profiles in a conventional small size image forming apparatus.

Referring now to FIG. 4, it should be readily apparent that the board 52 establishes a more regular and complete exhaust flow, thereby reducing areas in which the air can accumulate (i.e. Section C shown in FIG. 15). As also shown in FIG. 4, the flow develops along the widthwise direction of the fixing device 17, with the magnet 54 also extending along the width-wise direction of the fixing device 17. Thus, by reducing/preventing the flow under and around the housing of the fixing device, the board 52 improves the effectiveness of the exhaust. In accordance with another aspect of the present invention, the removal of toner by the magnet 54 is more effectively achieved by arranging the magnet so as to be coordinated with the flow achieved by the board 52. More particularly, as shown in FIG. 5A, the magnet 54 is arranged such that a plurality of poles alternately extend along the width direction of the board as shown by the alternating poles SNSN etc. Such an arrangement provides magnetic fields as shown in FIG. 5B. As the flow passes along the width-wise direction of the board, the air encounters the strongest portions of the magnetic field, and passes along the length of the magnet, thereby effectively removing floating toner from the air. FIG. 6 shows an exploded view of a portion of the magnetic field illustrated in FIG. 5B.

Figure 7:
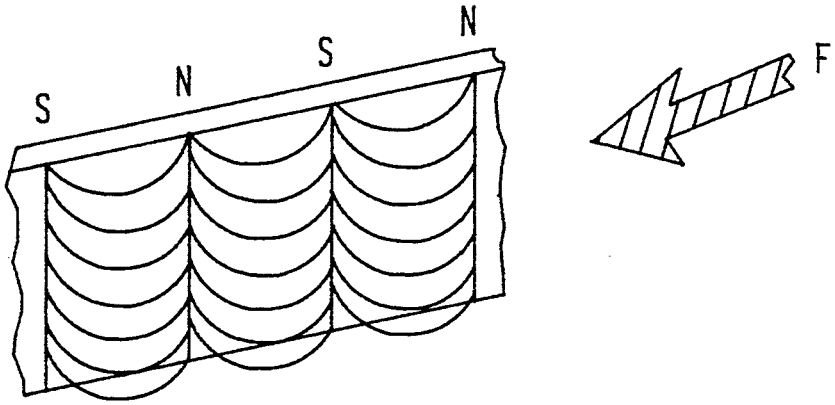
Figure 8:
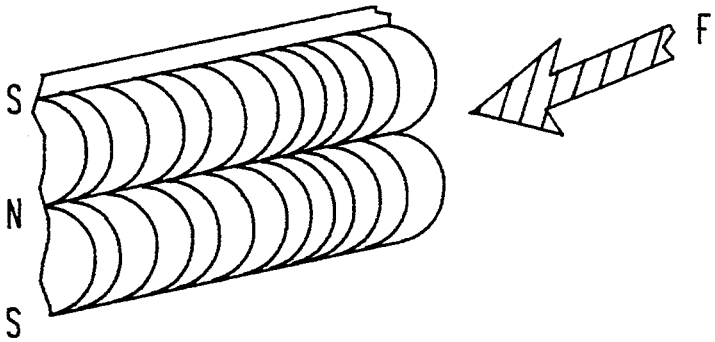

As shown in FIG. 7, as the flow F passes along the magnet, the air and substances contained therein encounter the strong magnetic fields produced by the alternating poles, and therefore removal of the toner is enhanced. In addition, since the flow is chiefly along the length of the magnet, the air encounters numerous magnetic fields. By contrast, if the magnet were arranged such that the alternating poles were transverse to the direction of the flow F, for example as shown in FIG. 8, the magnet is not as effective in capturing and removing toner from the air. Accordingly, in accordance with another aspect of the present invention, by coordinating the arrangement of the magnet and the alternating poles of the magnet with the air flow, removal of toner by the magnet is enhanced.

Figure 9:
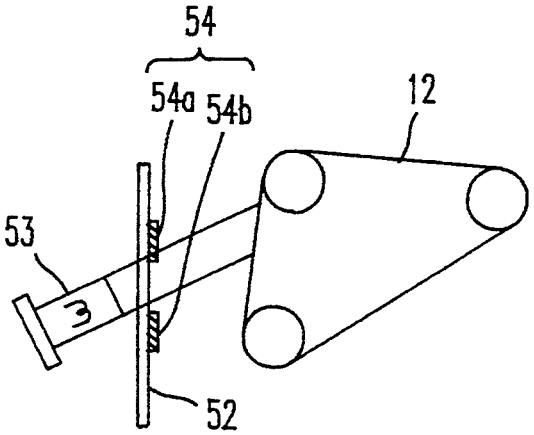
FIGS. 9–12 illustrate double magnet arrangements and the resulting magnetic fields.
Figure 10:
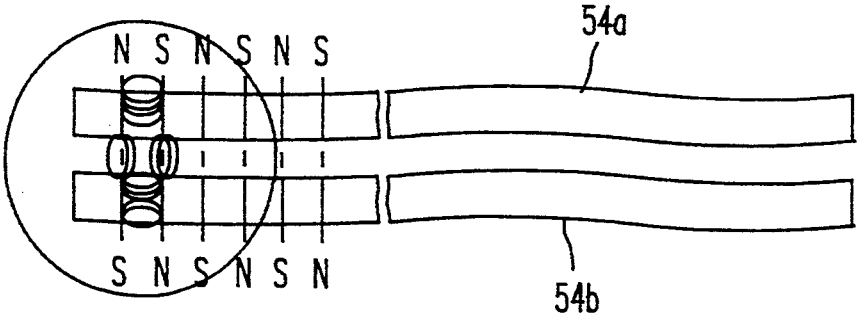
Figure 11:
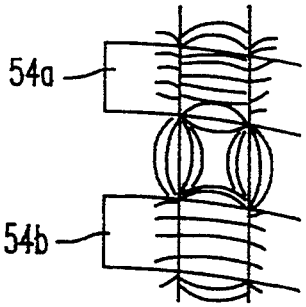

Referring now to FIGS. 9–11, another embodiment of the present invention will be described together with the additional advantageous results achieved thereby. As shown in FIG. 9, a pair of magnets can be provided on the flow improvement board 52, with the magnets 54 arranged at upper and lower locations with respect to the optical discharger 53. In testing arrangements in which the magnet is utilized together with a transparent board, adherence of toner to the light transmitting part of the board 52 was not found to be a problem, and therefore cleaning is unnecessary during normal use, since the magnetic type toner is readily captured by the magnet 54. The FIG. 9 arrangement can be particularly advantageous in preventing accumulation of toner at the light transmitting portion of the board 52.

The use of a pair of magnets can be particularly advantageous in arrangements which include an optical discharger 53, however advantages of a two magnet arrangement can also be realized in image forming apparatuses which do not include an optical discharger 53. For example, as shown in FIG. 10, by arranging a pair of magnets 54*a*, 54*b*, the magnets can be arranged such that the poles of the upper magnet are opposite to that of the corresponding pole of the lower magnet. As shown in FIG. 10, it will be noted that the North poles of the magnet 54*a* are disposed vertically above the South poles of the magnet 54*b*. As a result, strong electric fields are disposed not only extending in the widthwise direction of the fixing device 17, but also in the vertical direction, as illustrated in FIG. 11. As a result, flows occurring in a variety of different directions encounter strong magnetic fields, thereby enhancing the ability of the magnet arrangement in capturing toner. Thus, the arrangements shown in FIGS. 9–11 are advantageous in that, in addition to the more developed flow which extends along the width of the fixing device 17, flows which are vertical or diagonal may be handled by the magnet and floating toner can be removed by the two magnet arrangement.

Thus, the present invention improves exhaust characteristics in an image forming apparatus, and also reduces problems associated with undesirable substances and heat contained within the image forming apparatus. The flow improvement board enhances the effectiveness and completeness of the exhaust provided by a fan. In addition, the magnetic devices can reduce problems associated with floating toner. Moreover, the combined use of the board and magnet enhances the effectiveness of the magnet, with the orientation of the magnet coordinated with the flow resulting along the board.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An image forming apparatus having improved exhaust flow comprising:

an image carrier;

fixing means for fixing toner which has been transferred to a sheet of paper;

an exhaust device for exhausting air from an interior portion of said image forming apparatus;

a flow improvement board located between said image carrier and said fixing means, said flow improvement board improving the effectiveness of said exhaust device by improving the exhaust flow of air located between the image carrier and the fixing means;

the apparatus further including conveying means for conveying the sheet of paper to a transfer device at which toner is transferred to said sheet, said means for conveying further conveying said sheet from said transfer device to said fixing means in a direction substantially parallel to a bottom plane of said apparatus, and wherein said transfer device is disposed such that toner adheres to an underside of the paper;

wherein said flow improvement board extends along a width of a housing of said fixing means with said flow improvement board adjacent said housing, and also extends downwardly to a location below a lowermost portion of said housing of the fixing means such that an exhaust passage is defined between said flow improvement board and said image carrier and the apparatus further including at least one magnet located between said image carrier and said fixing means, and wherein said at least one magnet is mounted upon said flow improvement board.

2. The image forming apparatus of claim 1, wherein said fixing means and image carrier are closely adjacent to one another such that said sheet of paper contacts a part of said fixing means and a part of said image carrier simultaneously.

3. The image forming apparatus of claim 1, wherein a pair of magnets are mounted upon said flow improvement board.

4. An image forming apparatus having improved exhaust flow comprising:

an image carrier;

fixing means for fixing toner which has been transferred to a sheet of paper;

an exhaust device for exhausting air from an interior portion of said image forming apparatus; and a flow improvement board located between said image carrier and said fixing means, said flow improvement board improving the effectiveness of said exhaust device by improving the exhaust flow of air located between the image carrier and the fixing means;

wherein an optical discharger is installed below said fixing means, and wherein a portion of said flow improvement board is located between the optical discharger and the image carrier, and wherein said flow improvement board includes a transparent material to allow said optical discharger to operate through said board.

5. The image forming apparatus of claim 4 wherein a first magnet is mounted upon the flow improvement board above a location through which said optical discharger operates, with a second magnet mounted upon said flow improvement board below the location through which the optical discharger operates.

6. The image forming apparatus of claim 1, wherein said exhaust device is disposed with respect to said flow improvement board such that an exhaust flow is directed along a widthwise direction of said flow improvement board, said widthwise direction of said flow improvement board extending along a width of said housing of said fixing means.

7. The image forming apparatus of claim 6, wherein said flow improvement board is mounted upon said housing of said fixing means.

8. An image forming apparatus in which a latent image on an image carrier is developed by a developing device, with the image transferred onto a sheet of paper, said image forming apparatus comprising:

an image carrier;

a fixing device for fixing toner which has been transferred to a sheet of paper;

a first magnet for capturing floating toner located between the fixing device and the image carrier, said first magnet located within a passage, said passage at least partially defined by a flow improvement board, said flow improvement board located between said fixing device and said image carrier, said first magnet disposed between said flow improvement board and said image carrier; and said image forming apparatus further including exhausting means for exhausting air.

9. The image forming apparatus of claim 8, further including a second magnet disposed at a location below said first magnet.

10. The image forming apparatus of claim 8, further including a second magnet mounted at a location below the first mentioned magnet, and wherein each of said magnets includes a plurality of poles which alternately extend along a widthwise direction of the fixing device, and further wherein poles of the first magnet are opposite to respective poles of the second magnet which are vertically below the first magnet.

11. The image forming apparatus of claim 8, wherein said first magnet is mounted upon said flow improvement board.

12. The image forming apparatus of claim 11, wherein said flow improvement board extends substantially along an entire width of the fixing device, and is mounted upon the fixing device, and wherein said first magnet includes a plurality of poles alternating in the widthwise direction of the fixing device.

13. The image forming apparatus of claim 12, wherein a second magnet is provided having alternating poles extending along the widthwise direction of the fixing device, and wherein said second magnet is mounted at a location below the first magnet, and further wherein poles of the first magnet are opposite to poles of the second magnet which are vertically below the first magnet.

14. The image forming apparatus of claim 13, wherein said flow improvement board includes a transparent material.

15. An image forming apparatus in which a latent image on an image carrier is developed by a developing device, with the image transferred onto a sheet of paper, said image forming apparatus comprising:

an image carrier;

a fixing device for fixing toner which has been transferred to a sheet of paper; and a magnet for capturing floating toner located between the fixing device and the image carrier;

wherein said magnet extends along a width of the fixing device, and further wherein said magnet includes a plurality of alternating poles extending along a width of the fixing device.

16. An image forming apparatus in which a latent image is formed on an image carrier, with the image developed by a developing device and transferred onto a sheet of paper, said image forming apparatus comprising:

an image carrier;

a fixing device for fixing toner by heat onto a sheet of paper;

an exhaust device for exhausting air located between the image carrier and the fixing device;

a flow improvement board located between the image carrier and the fixing device, said flow improvement board improving completeness of exhaustion of air between the image carrier and the fixing device; and a magnet located between the image carrier and the fixing device for capturing floating toner, wherein said magnet is located upon said flow improvement board.

17. An image forming apparatus of claim 16, wherein said magnet is one of a pair of substantially parallel magnets mounted upon said flow improvement board, wherein said pair of magnets extend along a widthwise direction of the fixing device.

18. The image forming apparatus of claim 17, further including an optical discharger disposed below said fixing device, and wherein said flow improvement board extends between said optical discharger and said image carrier, said flow improvement board including a transparent material thereby allowing said optical discharger to operate through said flow improvement board, and further wherein one of said pair of magnets is disposed above a location through which the optical discharger operates, and the other magnet is disposed below a location through which the optical discharger operates.

19. The image forming apparatus of claim 16, wherein said magnet extends along a widthwise direction of said fixing device, and further wherein said magnet includes a plurality of poles alternately extending in the widthwise direction.

20. The image forming apparatus of claim 16, wherein said magnet is one of a pair of magnets, wherein said pair of magnets each extend along a widthwise direction of the fixing device, with each magnet including alternating poles extending along the widthwise direction, and wherein one of said pair of magnets is disposed below the other of said pair of magnets, and further wherein poles of said other of said pair of magnets are opposite to corresponding poles of said one of said pair of magnets located vertically below the other of said pair of magnets.

* * * * *